US010948220B2

(12) United States Patent
Lee et al.

(10) Patent No.: US 10,948,220 B2
(45) Date of Patent: Mar. 16, 2021

(54) TWO-STAGE COMPRESSOR

(71) Applicant: FU SHENG INDUSTRIAL CO., LTD., Taipei (TW)

(72) Inventors: Hsun-An Lee, Taipei (TW); Chung-Hung Yeh, Keelung (TW)

(73) Assignee: FU SHENG INDUSTRIAL CO., LTD., Taipei (TW)

( * ) Notice: Subject to any disclaimer, the term of this patent is extended or adjusted under 35 U.S.C. 154(b) by 63 days.

(21) Appl. No.: 16/431,731

(22) Filed: Jun. 4, 2019

(65) Prior Publication Data

US 2020/0041170 A1 Feb. 6, 2020

(30) Foreign Application Priority Data

Aug. 1, 2018 (TW) ..... 107126682

(51) Int. Cl.

| | |
|---|---|
| ***F25B 31/00*** | (2006.01) |
| ***F25B 43/02*** | (2006.01) |
| ***F25B 1/047*** | (2006.01) |
| ***F25B 1/10*** | (2006.01) |

(52) U.S. Cl.

CPC ..... *F25B 1/10* (2013.01); *F25B 1/047* (2013.01); *F25B 31/002* (2013.01); *F25B 43/02* (2013.01); *F25B 2400/23* (2013.01)

(58) Field of Classification Search

CPC .. F25B 31/02; F25B 1/10; F25B 43/02; F04C 29/02; F04C 2240/809; F04B 39/0077; F04B 39/0284

See application file for complete search history.

(56) References Cited

U.S. PATENT DOCUMENTS

| | | | | |
|---|---|---|---|---|
| 3,147,914 A * | 9/1964 | Hatten | F04B 39/0077 417/363 |
| 5,328,344 A * | 7/1994 | Sato | F01C 21/102 418/85 |
| 2008/0152524 A1* | 6/2008 | Kishi | F04C 18/16 418/1 |

FOREIGN PATENT DOCUMENTS

| | | | |
|---|---|---|---|
| CN | 1080979 | A | 1/1994 |
| CN | 101218433 | A | 7/2008 |
| CN | 102859195 | A | 1/2013 |
| EP | 2 549 107 | A1 | 1/2013 |
| EP | 3 136 020 | A1 | 3/2017 |
| JP | 9-268988 | | 10/1997 |
| JP | H09-268988 | A | 10/1997 |
| JP | 2000-337282 | A | 12/2000 |

* cited by examiner

*Primary Examiner* — Cassey D Bauer
(74) *Attorney, Agent, or Firm* — Winston Hsu

(57) ABSTRACT

A two-stage compressor includes a casing, a first compression mechanism and a second compression mechanism. The casing has a first compression chamber, a second compression chamber and an oil tank, wherein the first compression chamber communicates with the second compression chamber and the oil tank is located in the second compression chamber. The first compression mechanism is disposed in the first compression chamber. The second compression mechanism is disposed in the second compression chamber and the second compression mechanism corresponds to the oil tank. The first compression mechanism and the second compression mechanism consume different amounts of lubricant oil respectively.

7 Claims, 3 Drawing Sheets

TWO-STAGE COMPRESSOR

BACKGROUND OF THE INVENTION

1. Field of the Invention

The invention relates to a two-stage compressor and, more particularly, to a two-stage compressor capable of lubricating different compression mechanisms by different lubricating manners.

2. Description of the Prior Art

A two-stage compressor improves efficiency for refrigeration cycle by multi-stage compression to save energy. The inside of the two-stage compressor is essentially equipped with the different compression mechanisms, e.g. a screw compression mechanism and a scroll compression mechanism. In general, the screw compression mechanism needs to be lubricated by more lubricant oil and the scroll compression mechanism needs to be lubricated by less lubricant oil. In other words, different compression mechanisms require different lubricating manners. At present, the prior art always lubricates different compression mechanisms by the same lubricating manner, such that the lubricating effect cannot be improved. Therefore, how to lubricate different compression mechanisms by different lubricating manners and how to satisfy two compression mechanisms with different amounts of lubricant oil simultaneously have become a significant design issue for the two-stage compressor.

SUMMARY OF THE INVENTION

The invention provides a two-stage compressor capable of lubricating different compression mechanisms by different lubricating manners, so as to solve the aforesaid problems.

According to an embodiment of the invention, a two-stage compressor comprises a casing, a first compression mechanism and a second compression mechanism. The casing has a first compression chamber, a second compression chamber and an oil tank, wherein the first compression chamber communicates with the second compression chamber and the oil tank is located in the second compression chamber. The first compression mechanism is disposed in the first compression chamber. The second compression mechanism is disposed in the second compression chamber and the second compression mechanism corresponds to the oil tank. The first compression mechanism and the second compression mechanism consume different amounts of lubricant oil.

As mentioned in the above, the invention disposes the oil tank corresponding to the second compression mechanism in the second compression chamber. When the two-stage compressor is operating, the two-stage compressor outputs an oil and refrigerant gas mixture to an oil separator. Then, the oil separator separates lubricant oil or refrigerant gas from the oil and refrigerant gas mixture and then transmits the lubricant oil to the first compression chamber of the two-stage compressor. The lubricant oil entering the first compression chamber lubricates the first compression mechanism. Then, the lubricant oil flows from the first compression chamber into the oil tank of the second compression chamber. When the second compression mechanism is operating, the second compression mechanism stirs the lubricant oil in the oil tank to nebulize the lubricant oil. The nebulized lubricant oil lubricates the second compression mechanism. Accordingly, the two-stage compressor of the invention can lubricate different compression mechanisms by different lubricating manners and satisfy two compression mechanisms with different amounts of lubricant oil simultaneously, so as to improve the lubricating effect.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
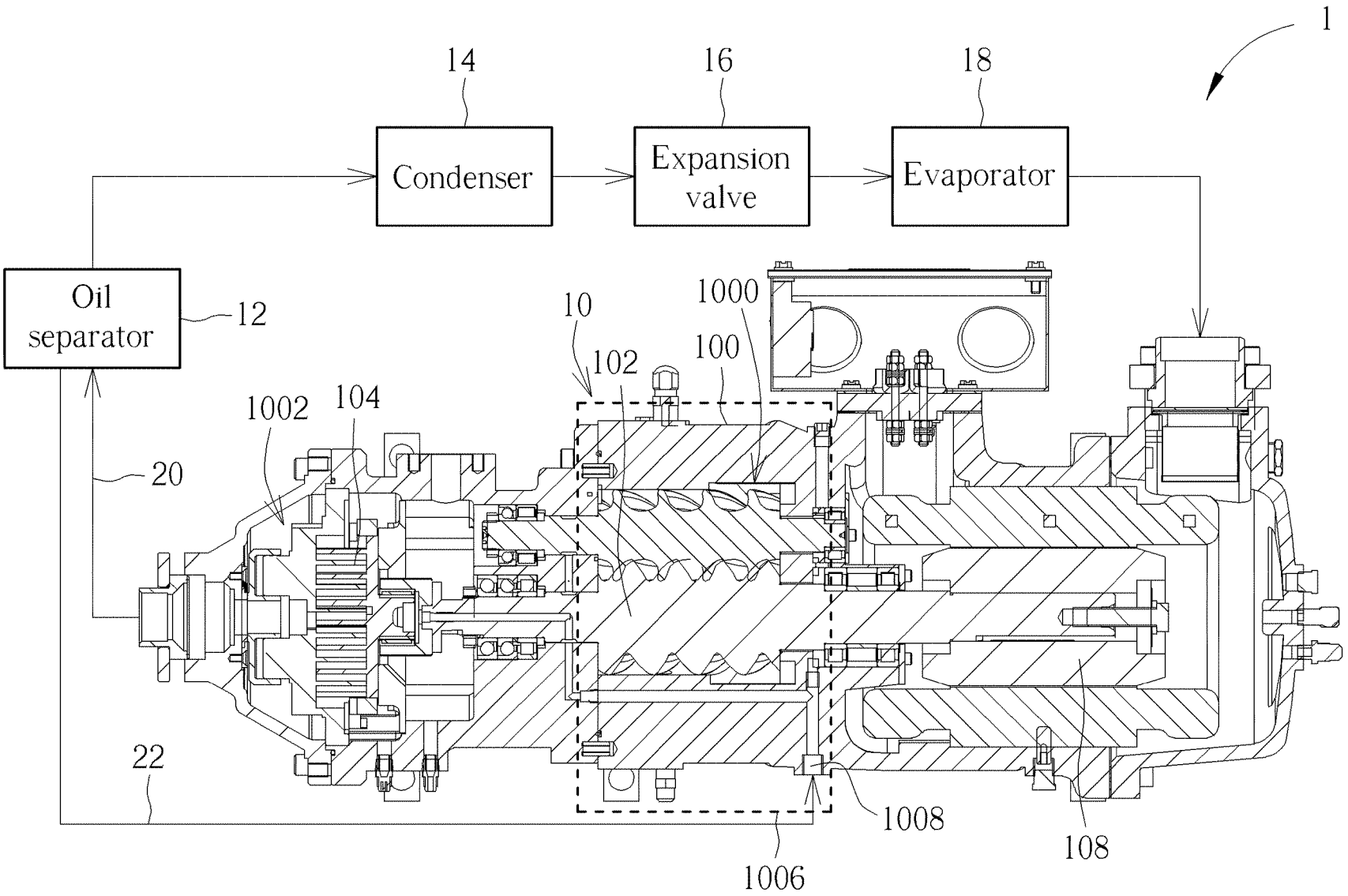
FIG. 1 is a schematic diagram illustrating a compression system according to an embodiment of the invention.
Figure 2:
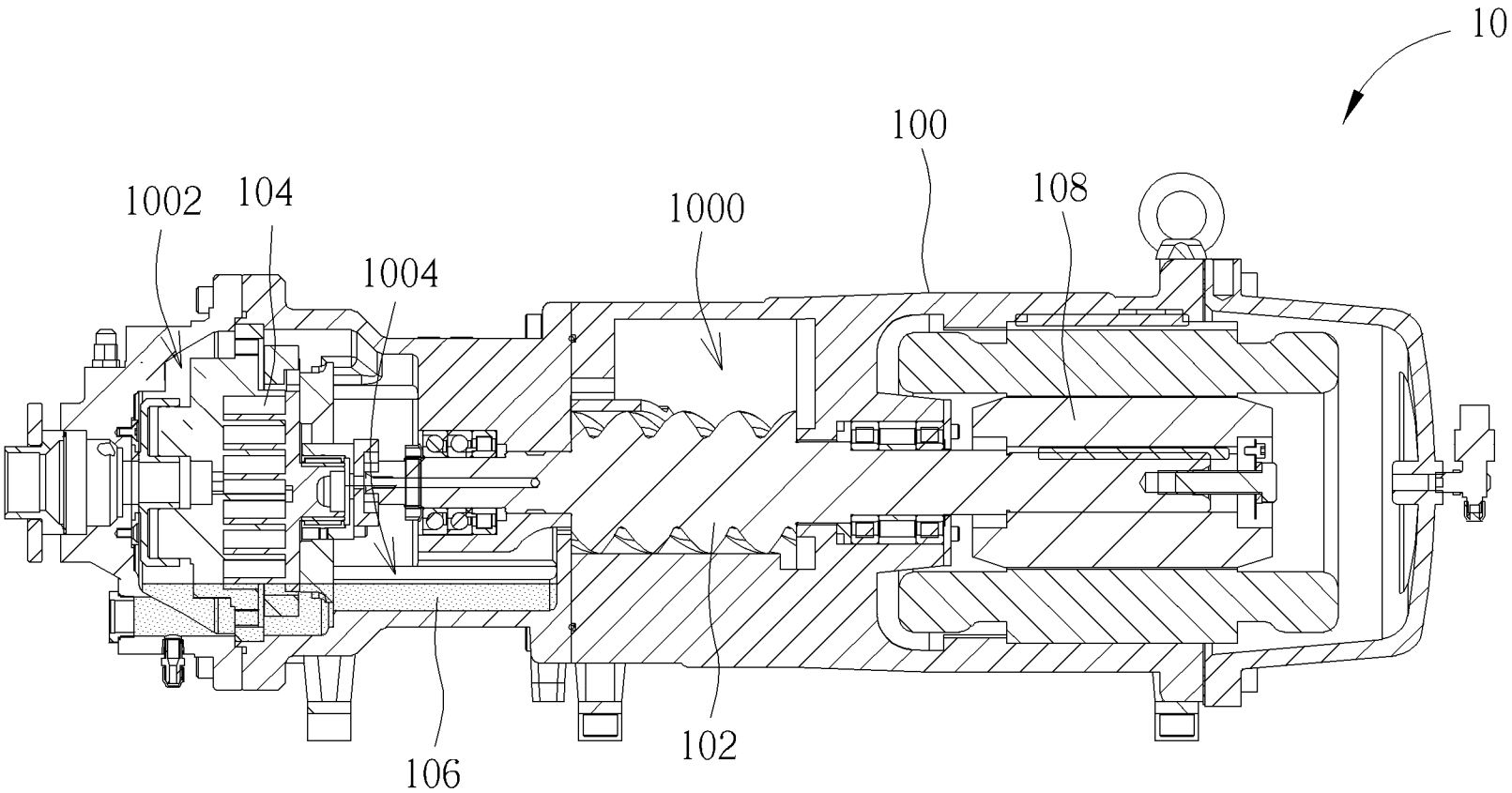
FIG. 2 is a schematic diagram illustrating the two-stage compressor shown in FIG. 1 from another viewing angle.
Figure 3:
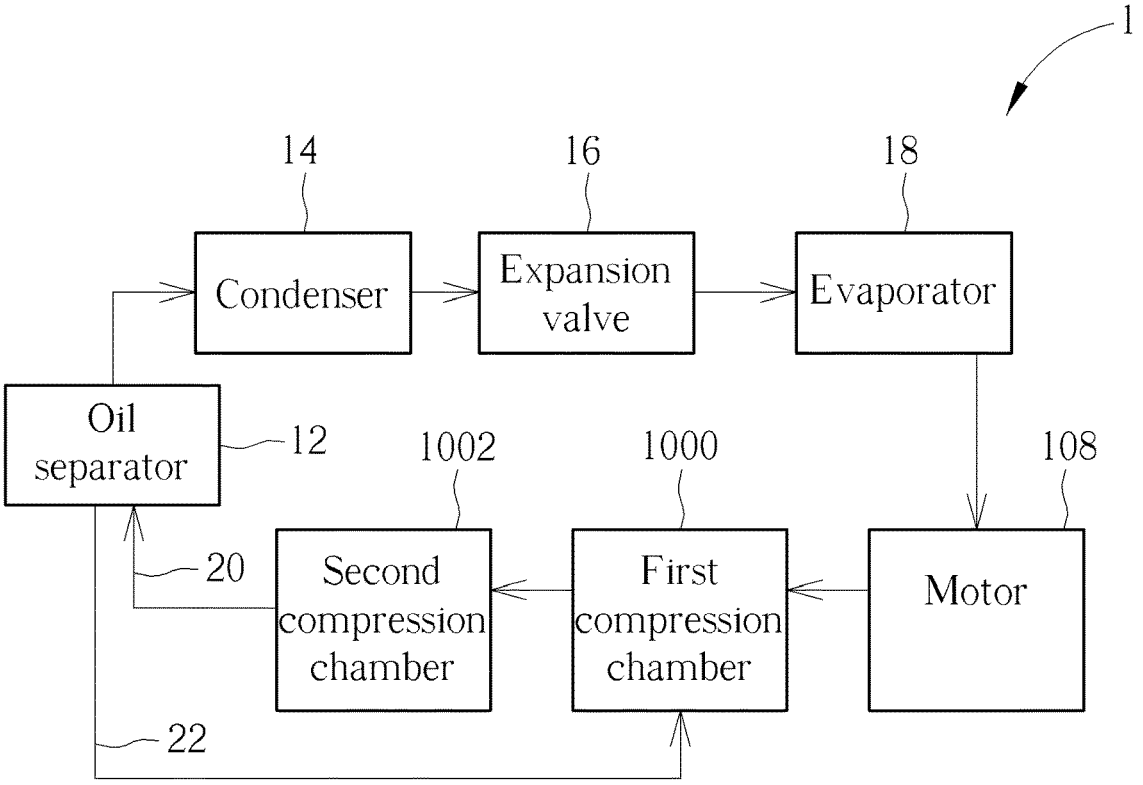
FIG. 3 is a functional block diagram illustrating the compression system shown in FIG. 1.

Referring to FIGS. 1 to 3, FIG. 1 is a schematic diagram illustrating a compression system 1 according to an embodiment of the invention, FIG. 2 is a schematic diagram illustrating the two-stage compressor 10 shown in FIG. 1 from another viewing angle, and FIG. 3 is a functional block diagram illustrating the compression system 1 shown in FIG. 1. As shown in FIG. 1, in addition to the two-stage compressor 10, the compression system 1 further comprises an oil separator 12, a condenser 14, an expansion valve 16 and an evaporator 18, such that the compression system 1 forms a refrigerant compression system. It should be noted that the principles of the oil separator 12, the condenser 14, the expansion valve 16 and the evaporator 18 are well known by one skilled in the art, so those will not be depicted herein. Furthermore, the two-stage compressor 10 of the invention may also be applied to a refrigeration system or other systems equipped with a compressor.

As shown in FIGS. 1 and 2, the two-stage compressor 10 comprises a casing 100, a first compression mechanism 102 and a second compression mechanism 104. The oil separator 12 may be connected to the casing 100 of the two-stage compressor 10 through two tubes 20, 22. The casing 100 has a first compression chamber 1000, a second compression chamber 1002 and an oil tank 1004, wherein the first compression chamber 1000 communicates with the second compression chamber 1002 and the oil tank 1004 is located in the second compression chamber 1002. In this embodiment, the oil tank 1004 may be located at a bottom of the second compression chamber 1002, but is not so limited. Furthermore, a low pressure region 1006 of the first compression chamber 1000 has at least one oil inlet 1008 and the oil inlet 1008 may be disposed at any position of the low pressure region 1006. It should be noted that this embodiment is exemplified by one oil inlet 1008, but is not so limited. The oil inlet 1008 is connected to the oil separator 12 through the tube 22.

The first compression mechanism 102 is disposed in the first compression chamber 1000 and the second compression mechanism 104 is disposed in the second compression chamber 1002, wherein the second compression mechanism 104 corresponds to the oil tank 1004. The first compression mechanism 102 and the second compression mechanism 104 consume different amounts of lubricant oil. In the following, this embodiment is exemplified by that the amount of lubricant oil consumed by the second compression mechanism 104 is less than the amount of lubricant oil consumed by the first compression mechanism 102, but is not so limited. In another embodiment, the amount of lubricant oil consumed by the first compression mechanism 102 may be less than the amount of lubricant oil consumed by the second compression mechanism 104 according to practical applications for the two-stage compressor 10. In this embodiment, the first compression mechanism 102 may be a screw compression mechanism, a piston compression mechanism or a centrifugal compression mechanism, and the second compression mechanism 104 may be a scroll compression mechanism, a piston compression mechanism or a rotary compression mechanism. For example, if the first compression mechanism 102 is a screw compression mechanism or a centrifugal compression mechanism, the second compression mechanism 104 may be a scroll compression mechanism, a piston compression mechanism or a rotary compression mechanism; and if the first compression mechanism 102 is a piston compression mechanism, the second compression mechanism 104 may be a scroll compression mechanism or a rotary compression mechanism.

When the two-stage compressor 10 is operating, the two-stage compressor 10 generates an oil and refrigerant gas mixture (e.g. an oil and refrigerant gas mixture including lubricant oil and refrigerant gas) and outputs the oil and refrigerant gas mixture to the oil separator 12 through the tube 20. After the oil separator 12 receives the oil and refrigerant gas mixture from the two-stage compressor 10, the oil separator 12 separates the lubricant oil or the refrigerant gas from the oil and refrigerant gas mixture and then transmits the lubricant oil to the first compression chamber 1000 of the two-stage compressor 10 through the tube 22. According to practical applications, the oil separator 12 may cooperate with an oil cooler (not shown) on the tube 22 to reduce temperature of the lubricant oil. The oil cooler is connected to the oil separator 12 and the two-stage compressor 10. The lubricant oil is transmitted from the oil separator 12 to the oil cooler for cooling through the tube 22. Then, the oil cooler transmits the cooled lubricant oil to the first compression chamber 1000 of the two-stage compressor 10 through the tube 22. The lubricant oil entering the first compression chamber 1000 flows within the first compression chamber 1000 and lubricates the first compression mechanism 102. Then, the lubricant oil flows from the first compression chamber 1000 into the oil tank 1004 of the second compression chamber 1002 and a part of the lubricant oil flows from the first compression chamber 1000 into a motor 108 for lubricating a bearing thereof. In this embodiment, the amount of lubricant oil consumed by the second compression mechanism 104 is less than the amount of lubricant oil consumed by the first compression mechanism 102 and the oil tank 1004 is disposed with respect to the compression mechanism consuming less amount of lubricant oil (this embodiment is exemplified by the second compression mechanism 104, but is not so limited). Accordingly, by means of using the oil tank 1004 disposed in the second compression chamber 1002 to store the lubricant oil 106 from the first compression chamber 1000, a large amount of lubricant oil 106 will flow into the oil tank 1004 of the second compression chamber 1002 while entering the second compression chamber 1002, such that the operation efficiency of the second compression mechanism 104 will not be affected by excessive lubricant oil 106 and the invention can satisfy the first compression mechanism 102 and the second compression mechanism 104 with different amounts of lubricant oil simultaneously, as shown in FIG. 2. When the second compression mechanism 104 is operating, the second compression mechanism 104 stirs the lubricant oil 106 in the oil tank 1004 to nebulize the lubricant oil 106. The nebulized lubricant oil 106 is spread in the second compression chamber 1002 to lubricate the second compression mechanism 104. In practical applications, the nebulized lubricant oil 106 will be mixed with the refrigerant or other gases (e.g. air) in the second compression chamber 1002, so as to lubricate the second compression mechanism 104.

Figure 4:
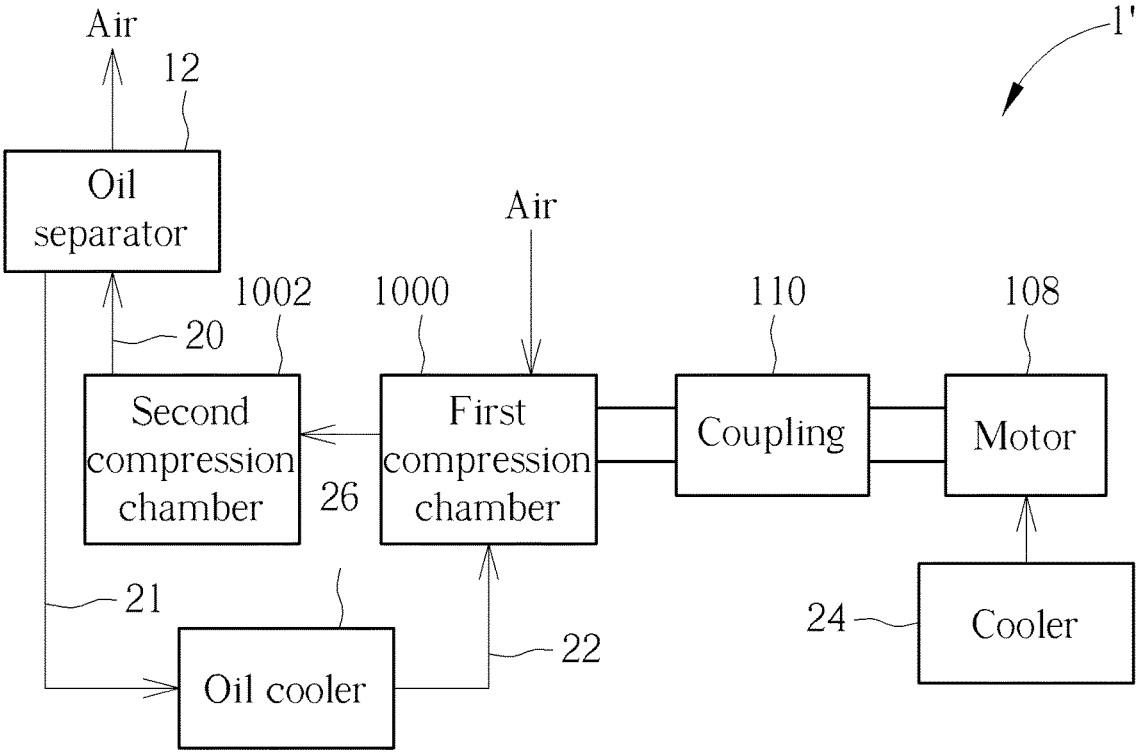
FIG. 4 is a functional block diagram illustrating a compression system according to another embodiment of the invention.

Referring to FIG. 4, FIG. 4 is a functional block diagram illustrating a compression system 1' according to another embodiment of the invention. Referring to FIG. 2 along with FIG. 4, in addition to be applied to the aforesaid compression system 1, the two-stage compressor 10 may also be applied to the compression system 1' shown in FIG. 4. At this time, the two-stage compressor 10 may further comprise a coupling 110, wherein the motor 108 connects and drives the first compression mechanism 102 of the first compression chamber 1000 to operate through the coupling 110. Furthermore, the motor 108 is connected to a cooler 24 of the compression system 1'. The cooler 24 may be wind cooling type cooler or a water cooling type cooler for reducing temperature of the motor 108. In addition to the two-stage compressor 10, the compression system 1' may further comprise an oil separator 12 and an oil cooler 26. The oil inlet 1008 may be connected to the oil cooler 26 through the tube 22 and the oil cooler 26 may be connected to the oil separator 12 through another tube 21. By means of the cooperation between the two-stage compressor 10, the cooler 24, the oil separator 12 and the oil cooler 26, the compression system 1' may form an air compression system.

Moreover, when the two-stage compressor 10 is operating, the two-stage compressor 10 generates an oil and refrigerant gas mixture (e.g. an oil and refrigerant gas mixture including lubricant oil and refrigerant gas) and outputs the oil and refrigerant gas mixture to the oil separator 12 through the tube 20. After the oil separator 12 receives the oil and refrigerant gas mixture from the two-stage compressor 10, the oil separator 12 separates the lubricant oil from the oil and refrigerant gas mixture and then transmits the lubricant oil to the oil cooler 26 through the tube 21 for cooling. Then, the oil cooler 26 transmits the cooled lubricant oil to the first compression chamber 1000 of the two-stage compressor 10 through the tube 22. The lubricant oil entering the first compression chamber 1000 from the oil inlet 1008 flows within the first compression chamber 1000 and lubricates the first compression mechanism 102. Then, the lubricant oil flows from the first compression chamber 1000 into the oil tank 1004 of the second compression chamber 1002. When the second compression mechanism 104 is operating, the second compression mechanism 104 stirs the lubricant oil 106 in the oil tank 1004 to nebulize the lubricant oil 106. The nebulized lubricant oil 106 is spread in the second compression chamber 1002 to lubricate the second compression mechanism 104.

As mentioned in the above, the invention disposes the oil tank corresponding to the second compression mechanism in the second compression chamber. When the two-stage compressor is operating, the two-stage compressor outputs an oil and refrigerant gas mixture to an oil separator. Then, the oil separator separates lubricant oil or refrigerant gas from the oil and refrigerant gas mixture and then transmits the lubricant oil to the first compression chamber of the two-stage compressor. The lubricant oil entering the first compression chamber lubricates the first compression mechanism. Then, the lubricant oil flows from the first compression chamber into the oil tank of the second compression chamber. When the second compression mechanism is operating, the second compression mechanism stirs the lubricant oil in the oil tank to nebulize the lubricant oil. The nebulized lubricant oil lubricates the second compression mechanism. Accordingly, the two-stage compressor of the invention can lubricate different compression mechanisms by different lubricating manners and satisfy two compression mechanisms with different amounts of lubricant oil simultaneously, so as to improve the lubricating effect.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A two-stage compressor comprising:

a casing having a first compression chamber, a second compression chamber and an oil tank, the first compression chamber communicating with the second compression chamber, the oil tank located in the second compression chamber;

a first compression mechanism disposed in the first compression chamber; and a second compression mechanism disposed in the second compression chamber, the second compression mechanism corresponding to the oil tank, the first compression mechanism and the second compression mechanism consuming different amounts of lubricant oil;

wherein the first compression mechanism and the second compression mechanism are different types of compression mechanisms, the oil tank stores lubricant oil, and the second compression mechanism contacts the lubricant oil; when the second compression mechanism is operating, the second compression mechanism directly stirs the lubricant oil to nebulize the lubricant oil.

2. The two-stage compressor of claim 1, wherein an oil separator is connected to the casing, the oil separator receives an oil and refrigerant gas mixture from the two-stage compressor, separates the lubricant oil from the oil and refrigerant gas mixture, and transmits the lubricant oil to the first compression chamber of the two-stage compressor.

3. The two-stage compressor of claim 2, wherein a condenser is connected to the oil separator, an expansion valve is connected to the condenser, and an evaporator is connected to the expansion valve and the two-stage compressor.

4. The two-stage compressor of claim 2, wherein an oil cooler is connected to the oil separator and the two-stage compressor.

5. The two-stage compressor of claim 1, wherein the first compression mechanism is a screw compression mechanism, a piston compression mechanism or a centrifugal compression mechanism, and the second compression mechanism is a scroll compression mechanism, a piston compression mechanism or a rotary compression mechanism.

6. The two-stage compressor of claim 1, wherein the amount of lubricant oil consumed by the second compression mechanism is less than the amount of lubricant oil consumed by the first compression mechanism.

7. The two-stage compressor of claim 1, wherein a low pressure region of the first compression chamber has at least one oil inlet and the at least one oil inlet is connected to an oil separator or an oil cooler.

* * * * *